US009744546B2

(12) United States Patent
Cvetan et al.

(10) Patent No.: US 9,744,546 B2
(45) Date of Patent: Aug. 29, 2017

(54) SAMPLE DISPENSER WITH PRIMING CRADLE

(71) Applicant: Conopco, Inc., Englewood Cliffs, NJ (US)

(72) Inventors: Christina Diane Cvetan, Toronto (CA); Andrew Zachery Wilder, Newburgh, NY (US)

(73) Assignee: Conopco, Inc., Englewood Cliffs, NJ (US)

( * ) Notice: Subject to any disclaimer, the term of this patent is extended or adjusted under 35 U.S.C. 154(b) by 46 days.

(21) Appl. No.: 14/880,551

(22) Filed: Oct. 12, 2015

(65) Prior Publication Data

US 2017/0100734 A1 Apr. 13, 2017

(51) Int. Cl.

| | |
|---|---|
| ***B65D 88/54*** | (2006.01) |
| ***B05B 11/00*** | (2006.01) |
| ***B05B 11/04*** | (2006.01) |
| ***B05B 15/06*** | (2006.01) |

(52) U.S. Cl.

CPC ..... *B05B 11/3001* (2013.01); *B05B 11/048* (2013.01); *B05B 11/3047* (2013.01); *B05B 15/061* (2013.01)

(58) Field of Classification Search

CPC ... B05B 11/04; B05B 11/048; B05B 11/3047; B05B 15/061

USPC ..... 222/251, 192, 93, 95, 96, 100, 105, 222/185.1; 206/557; 211/85.26

See application file for complete search history.

(56) References Cited

U.S. PATENT DOCUMENTS

| | | | | |
|---|---|---|---|---|
| 1,715,335 | A * | 5/1929 | Cocks | B65D 35/28 184/105.3 |
| 4,645,094 | A * | 2/1987 | Acklin | A47K 5/1217 222/103 |
| 5,638,989 | A * | 6/1997 | Ophardt | A47K 5/1207 222/105 |
| 8,353,427 | B2 * | 1/2013 | Landauer | A47K 5/12 222/108 |
| 8,474,654 | B2 | 7/2013 | Snow et al. | |
| 2009/0294479 | A1 | 12/2009 | Sottosanti, Jr. et al. | |
| 2015/0223645 | A1 * | 8/2015 | Ray | A47K 5/1211 222/156 |
| 2016/0185506 | A1 * | 6/2016 | Ciavarella | B65D 83/0072 222/96 |

* cited by examiner

*Primary Examiner* — Lien Ngo
(74) *Attorney, Agent, or Firm* — Edward A. Squillante, Jr.

(57) ABSTRACT

A sample dispenser includes a dosing unit, a cradle assembly, and tubing connecting the dosing unit and the cradle assembly. The dosing unit is configured to dispense sampling amounts of a flowable substance and includes a nozzle and a mechanical pump communicating with the nozzle. The cradle assembly includes a priming cradle configured to hold a compressible container of the flowable substance and to force the flowable substance out of the compressible container by applying a compressive force to the compressible container. The tubing allows communication of the flowable substance between the compressible container and the pump.

17 Claims, 12 Drawing Sheets

SAMPLE DISPENSER WITH PRIMING CRADLE

BACKGROUND

The present disclosure relates generally to a sample dispenser and method which allows a consumer to test products, especially flowable foods and personal care liquid products, prior to purchase in a retail establishment.

Retail stores such as department stores, drug stores, and specialty cosmetic stores often have counters displaying open packages that allow consumers to sample products prior to purchase. Some of these products are delivered in wide mouth jars. Others are packaged in less product exposed containers. Usually there is very little supervision in the sampling. Chances are high for microbial contamination. Still another issue is the scarcity of shelf space. Retailers prefer to use shelf space for purchasable product rather than for bulky non-revenue generating sample dispensers.

U.S. Patent Application Publication No. 2009/0294479 (Sottosanti et al.) discloses an on-shelf sample dispenser with a combined merchandising unit product display. There are some drawbacks with this technology. For example, it can be difficult to setup and refill the on-shelf sample dispenser since the refills need to be custom manufactured. Low unit volumes and specialty sourcing mean extra costs.

U.S. Pat. No. 8,474,654 (Snow et. al) discloses an in-store sample dispenser that uses retail bottles of the sampled product. However, it can be difficult to setup and refill the in-store sample dispenser since priming the sample dispenser requires a syringe to draw the product through a length of tubing. Additionally, a sharp hollow tube is required to puncture or pierce a hole in the retail bottle of the product.

Accordingly, there is a need for sample dispensers for a retail environment that can readily be primed and refilled. Moreover, there also is a need for a more efficient, less wasteful and quicker mechanism in replacing one product variant for another within the same sample dispensing system.

SUMMARY

One implementation of the present disclosure is a sample dispenser. The sample dispenser includes a dosing unit configured to dispense sampling amounts of a flowable substance. The dosing unit includes a nozzle and a mechanical pump communicating with the nozzle. The sample dispenser further includes a cradle assembly including a priming cradle configured to hold a compressible container of the flowable substance and to force the flowable substance out of the compressible container by applying a compressive force to the compressible container. The sample dispenser further includes tubing connecting the dosing unit and the cradle assembly allowing communication of the flowable substance between the compressible container and the pump.

In some embodiments, the priming cradle includes a substantially hollow shell having hingedly-connected front and rear portions configured to hold the compressible container therebetween. In some embodiments, the front portion is configured to rotate relative to the rear portion between an open position in which the priming cradle receives the compressible container and a closed position in which the priming cradle applies the compressive force to the compressible container.

In some embodiments, the priming cradle includes a tapered interior surface that applies the compressive force to the compressible container when the priming cradle is closed around the compressible container. In some embodiments, the tapered interior surface includes one or more notches or grooves configured to receive tabs of a flexible pressure plate. The pressure plate fits within the priming cradle and applies a compressive force to the compressible container when the priming cradle is closed around the compressible container.

In some embodiments, the cradle assembly includes a dock having a receiving area. The receiving area may have a floor and an upwardly-oriented hollow connector projecting upward from the floor. The hollow connector may be configured to attach to an opening in the compressible container. In some embodiments, the cradle assembly includes an L-shaped joint having a first end attached to the upwardly-oriented hollow connector and a second end attached to the tubing.

In some embodiments, the dock includes a perimeter wall projecting upward from the floor and at least partially surrounding the receiving area. The perimeter wall may be configured to hold the compressible container in an upward orientation within the receiving area. In some embodiments, the dock attaches to the compressible container and creates an airtight seal between the compressible container and the dock.

In some embodiments, the dock includes a retaining wall projecting upward from the floor and spaced from the perimeter wall. A lower edge of the priming cradle may be configured to fit within a space between the perimeter wall and the retaining wall when the priming cradle is attached to the dock.

In some embodiments, the dock includes one or more retaining clips projecting upward from the floor and spaced from the perimeter wall. The retaining clips may be configured to allow a lower edge of the priming cradle to slide over the retaining clips toward the perimeter wall and to hold the lower edge of the priming cradle between the retaining clips and the perimeter wall.

In some embodiments, the dosing unit includes an L-shaped joint having a first end attached to the mechanical pump and a second end attached to the tubing.

In some embodiments, the tubing extends substantially horizontally between the dosing unit and the cradle assembly. The sample dispenser may include an elongate tray extending substantially horizontally over the tubing between the dosing unit and the cradle assembly. In some embodiments, the elongate tray includes engagement features configured to releasably attach the elongate tray to at least one of the dosing unit and the cradle assembly.

In some embodiments, the priming cradle is configured to force the flowable substance through the tubing and into the dosing assembly. The mechanical pump may be configured to draw the flowable substance through the tubing once the flowable substance has reached the dosing assembly.

Another implementation of the present disclosure is a sample dispenser. The sample dispenser includes a dosing unit configured to dispense sampling amounts of a flowable substance. The dosing unit includes a nozzle and a mechanical pump communicating with the nozzle. The sample dispenser further includes a cradle assembly including a priming cradle configured to hold a compressible container of the flowable substance and to force the flowable substance out of the compressible container by applying a compressive force to the compressible container. The dosing unit is connected to the cradle assembly allowing communication of the flowable substance between the compressible container and the pump.

In some embodiments, the priming cradle includes a substantially hollow shell having hingedly-connected front and rear portions configured to hold the compressible container therebetween. In some embodiments, the front portion is configured to rotate relative to the rear portion between an open position in which the priming cradle receives the compressible container and a closed position in which the priming cradle applies the compressive force to the compressible container.

In some embodiments, the priming cradle includes a tapered interior surface that applies the compressive force to the compressible container when the priming cradle is closed around the compressible container. In some embodiments, the tapered interior surface includes one or more notches or grooves configured to receive tabs of a flexible pressure plate. The pressure plate fits within the priming cradle and applies a compressive force to the compressible container when the priming cradle is closed around the compressible container.

In some embodiments, the cradle assembly includes a dock having a receiving area. The receiving area may have a floor and an upwardly-oriented hollow connector projecting upward from the floor. The hollow connector may be configured to attach to an opening in the compressible container. In some embodiments, the dock attaches to the compressible container and creates an airtight seal between the compressible container and the dock.

Another implementation of the present disclosure is a method for dispensing a flowable substance from a sample dispenser. The method includes providing a sample dispenser having a cradle assembly, a dosing unit, and tubing connecting the cradle assembly to the dosing unit. The method further includes attaching a compressible container of the flowable substance to a hollow connector of the cradle assembly. The method further includes applying a compressive force to the compressible container by closing the cradle assembly around the compressible container. The compressive force causes the flowable substance to flow out of the compressible container, through the tubing, and into the dosing unit. The method further includes operating a mechanical pump of the dosing unit to dispense the flowable substance from a nozzle of the dosing unit communicating with the mechanical pump.

In some embodiments, applying the compressive force to the compressible container includes closing a priming cradle of the cradle assembly around the compressible container. The priming cradle may include a tapered interior surface that applies the compressive force to the compressible container when the priming cradle is closed around the compressible container. In some embodiments, the tapered interior surface includes one or more notches or grooves configured to receive tabs of a flexible pressure plate. The pressure plate fits within the priming cradle and applies a compressive force to the compressible container when the priming cradle is closed around the compressible container.

In some embodiments, attaching the compressible container to the hollow connector includes placing the compressible container in a dock of the cradle assembly. The dock may include a receiving area. The receiving area may have a floor and a hollow connector projecting upward from the floor.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1:
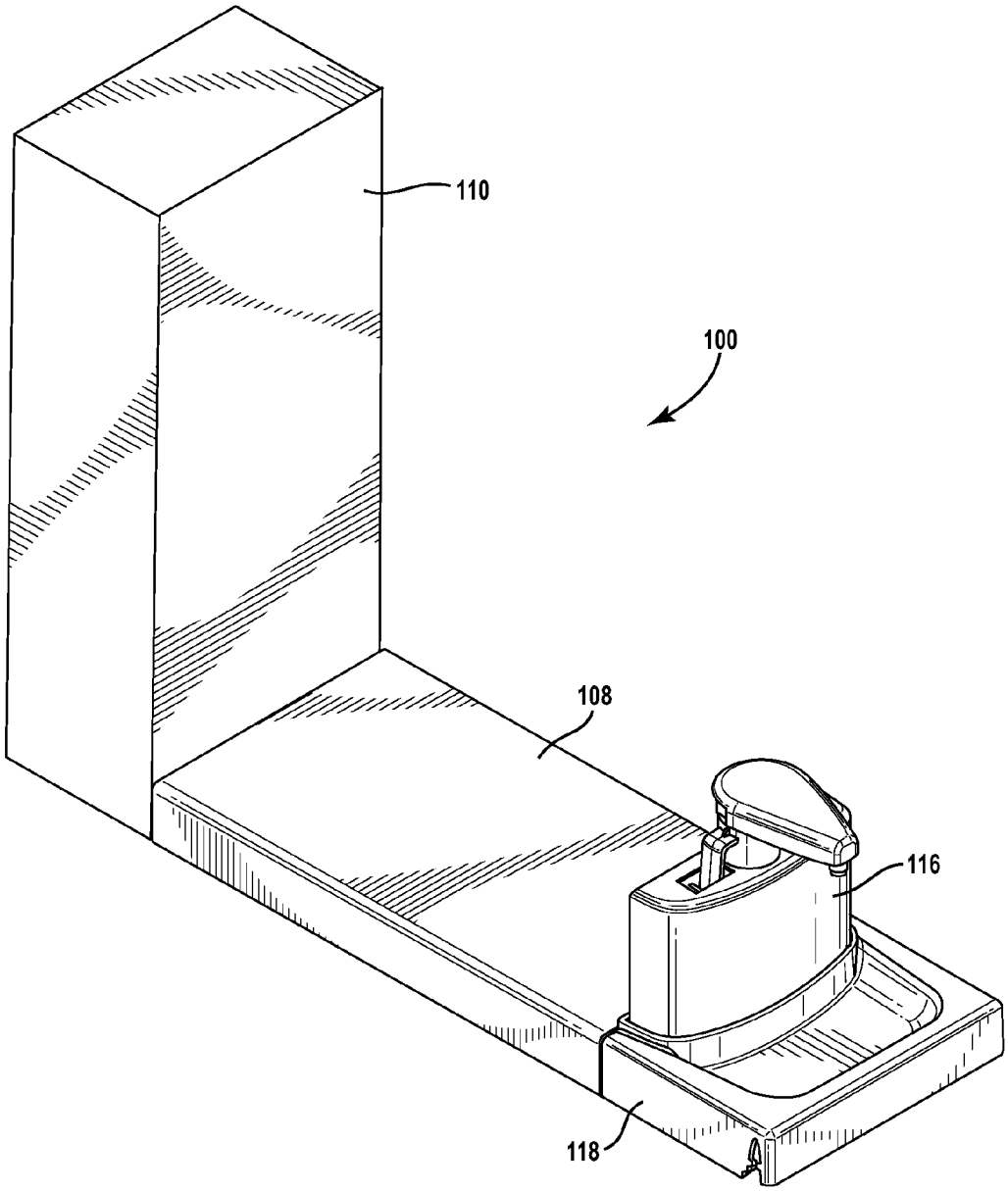
FIG. 1 is a drawing of a sample dispenser, according to an exemplary embodiment.

Referring generally to the FIGURES, a sample dispenser is shown, according to various exemplary embodiments. The sample dispenser may be implemented in a retail setting to allow a consumer to dispense sampling amounts of a flowable substance. A variety of flowable substances are suitable for use with the sample dispenser. For example, the sample dispenser may be used to dispense personal care products (e.g., cosmetics, perfumes, lotions, creams, balms, serums, sunblocks, sunless tanners, deodorants, antiperspirants, foams, mousse, hand soaps, shampoos, etc.), food products (e.g., ketchup, mustard, mayonnaise, salad dressing, etc.), or any of a variety of other flowable substances (e.g., liquids, gasses, viscous and non-viscous fluids, aerosols, etc.).

The sample dispenser includes a dosing unit, a cradle assembly, and optionally a length of tubing connecting the dosing unit to the cradle assembly. The cradle assembly includes a priming cradle configured to hold a compressible container of a flowable substance and to force the flowable substance out of the compressible container by applying a compressive force to the compressible container. In some embodiments, the priming cradle includes a tapered interior surface that applies the compressive force to the compressible container when the priming cradle is closed around the compressible container. In some embodiments, the tapered interior surface includes one or more notches or grooves configured to receive tabs of a flexible pressure plate. The pressure plate fits within the priming cradle and applies a compressive force to the compressible container when the priming cradle is closed around the compressible container.

In some embodiments, the cradle assembly includes a dock. The dock may include a receiving area configured to hold the compressible container. The dock may further include an upwardly-oriented hollow connector configured to attach to an opening in the compressible container. When the compressive force is applied to the compressible container, the flowable substance is forced out of the compressible container, into the hollow connector, and into the dosing unit (e.g., either directly or via the tubing).

In some embodiments, the compressive force provided by the priming cradle is used only to prime the sample dispenser. Priming the sample dispenser may include increasing the pressure within the compressible container (i.e., using the priming cradle), which forces the flowable substance to initially exit the compressible container and flow into the dosing unit. Once the flowable substance reaches the dosing unit, priming is completed and the compressive force provided by the priming cradle is no longer required.

After priming is completed, the dosing unit can be operated to draw more of the flowable substance out of the compressible container and into the dosing unit. For example, the dosing unit may include a nozzle and a mechanical pump communicating with the nozzle. The mechanical pump can be operated by a user to create a suction within the dosing unit and draw the flowable substance into the dosing unit. A sampling amount of the flowable substance may then be dispensed from an outlet connected to the nozzle of the dosing unit.

Before discussing the sample dispenser in greater detail, it should be noted that references herein to the positions or directions of elements (e.g., "top," "bottom," "above," "below," "front," "rear," "right," "left," etc.) are merely used to describe the orientation of various elements as they appear in the FIGURES. It is contemplated that the orientation of elements may differ according to other exemplary embodiments. All such variations are intended to be encompassed by the present disclosure.

Figure 2:
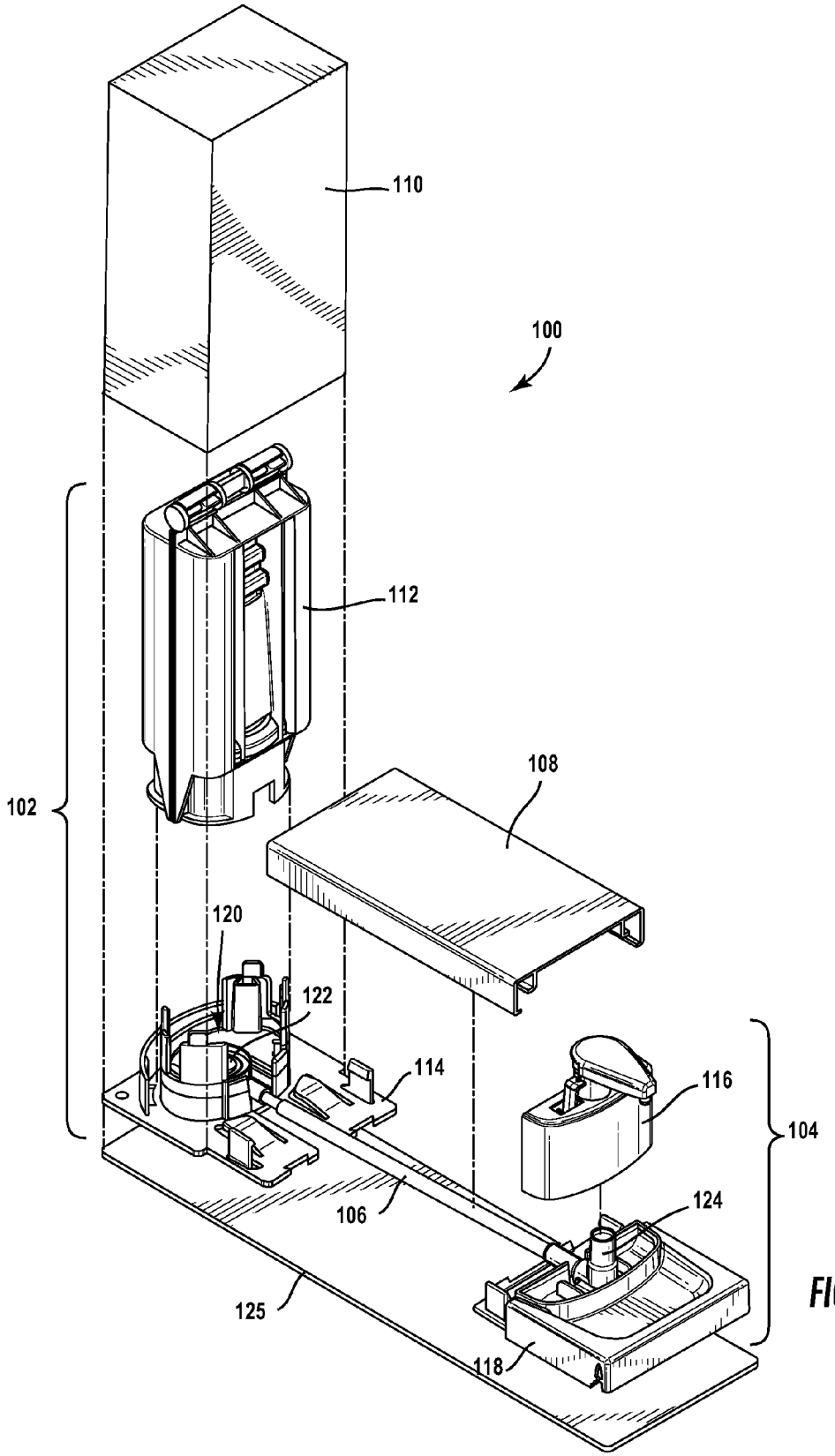
FIG. 2 is an exploded view of the sample dispenser of FIG. 1, showing a priming assembly including a priming cradle a dock, a dosing assembly including a dosing unit and a base, a length of tubing connecting the priming assembly to the dosing assembly, and an elongate cover extending over the length of tubing, according to an exemplary embodiment.

Referring now to FIGS. 1-2, a sample dispenser 100 is shown, according to an exemplary embodiment. FIG. 1 is a perspective view of sample dispenser 100 in an assembled state in which sample dispenser 100 may be used by a consumer. FIG. 2 is an exploded view of sample dispenser 100 illustrating several of the components of sample dispenser 100 that are not externally visible. Sample dispenser 100 is shown to include a cradle assembly 102, a dosing assembly 104, and tubing 106 connecting cradle assembly 102 and dosing assembly 104.

Cradle assembly 102 is shown to include a priming cradle 112 and a dock 114. Priming cradle 112 may be configured to hold a compressible container 105 (shown in FIG. 14) of a flowable substance. In some embodiments, priming cradle 112 includes a substantially hollow shell having hingedly-connected front and rear portions configured to hold compressible container 105 therebetween. Compressible container 105 may be any type of container that can be compressed or squeezed to cause the substance contained therein to be forced out of compressible container 105 (e.g., through an opening in compressible container 105). For example, compressible container 105 may include a tube of lotion or other consumer products, a bottle of ketchup or other food products, and/or any other type of container that can be compressed to dispense the flowable substance contained therein. Priming cradle 112 may be configured to apply a compressive force to compressible container 105 of the flowable substance to force the flowable substance out of compressible container 105. Priming cradle 112 is described in greater detail with reference to FIGS. 3-4.

Dock 114 may be configured to receive and support compressible container 105 of the flowable substance within a receiving area 120. For example, compressible container 105 may be placed into receiving area 120 such that an opening of compressible container 105 engages an upwardly-oriented hollow connector 122 projecting upward from a floor of dock 114. One end of hollow connector 122 may fit within an opening in compressible container 105, whereas the other end of hollow connector 122 attaches to tubing 106. Dock 114 is described in greater detail with reference to FIGS. 5-6.

Once compressible container 105 has been placed onto dock 114, priming cradle 112 may be inserted onto dock 114 around compressible container 105. Priming cradle 112 may be closed around compressible container 105 to force the flowable substance out of compressible container 105 and into tube 106. The compressive force exerted by priming cradle 112 causes the flowable substance to flow through tube 106 and into dosing assembly 104.

Dosing assembly 104 is shown to include a dosing unit 116 and a base 118. Dosing unit 116 may include a nozzle, a mechanical pump, or other components configured to dispense sampling amounts of the flowable substance. Base 118 may include molded components configured to hold and/or support dosing unit 116. In some embodiments, dosing assembly 104 includes an L-shaped joint 124 having a first end attached to the mechanical pump and a second end attached to tubing 106. Dosing assembly 104 is described in greater detail with reference to FIGS. 7-10.

Figure 19:
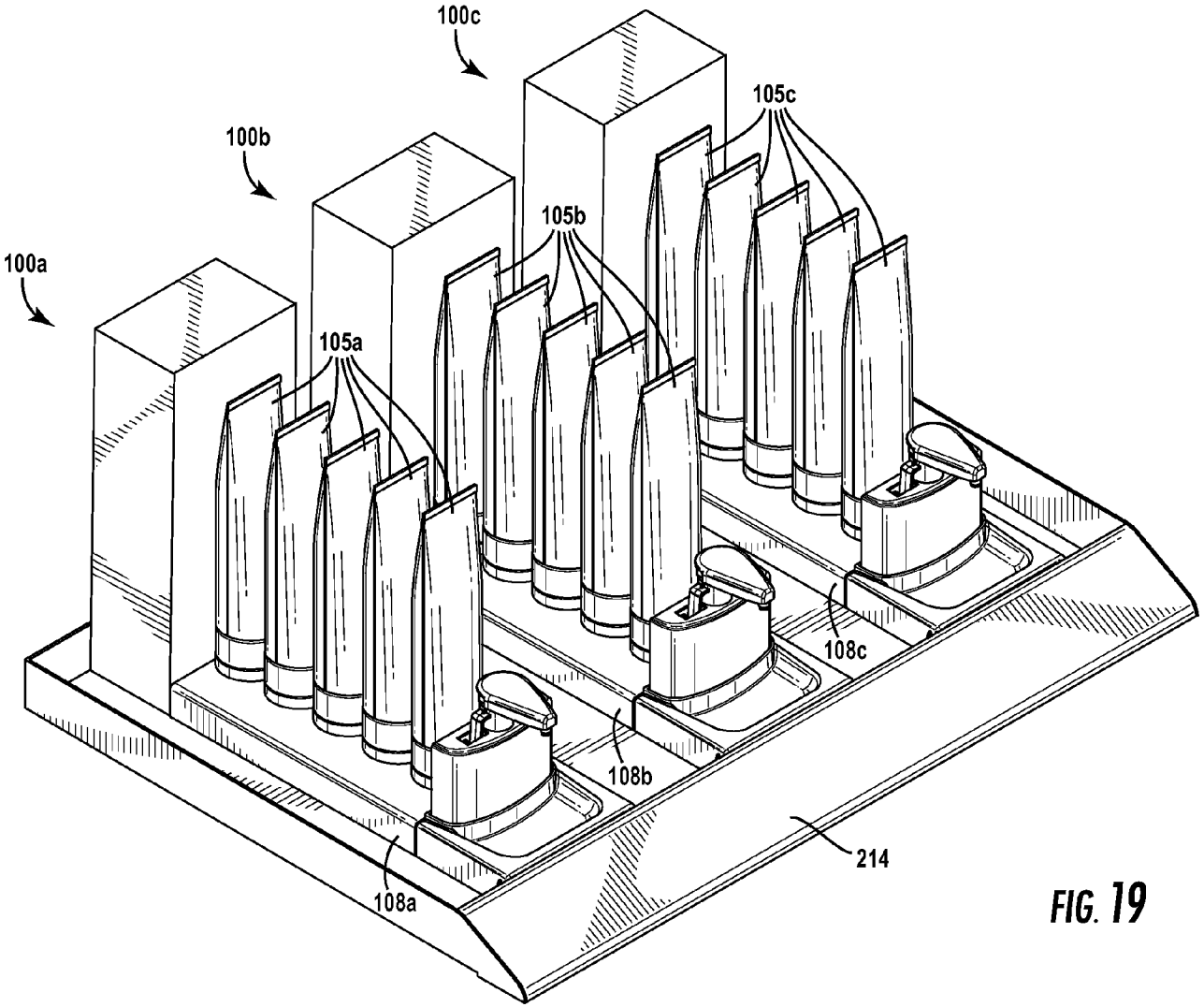
FIG. 19 is a drawing of several instances of the sample dispenser of FIG. 1 arranged side-by-side in a display tray, according to an exemplary embodiment.
Figure 20:
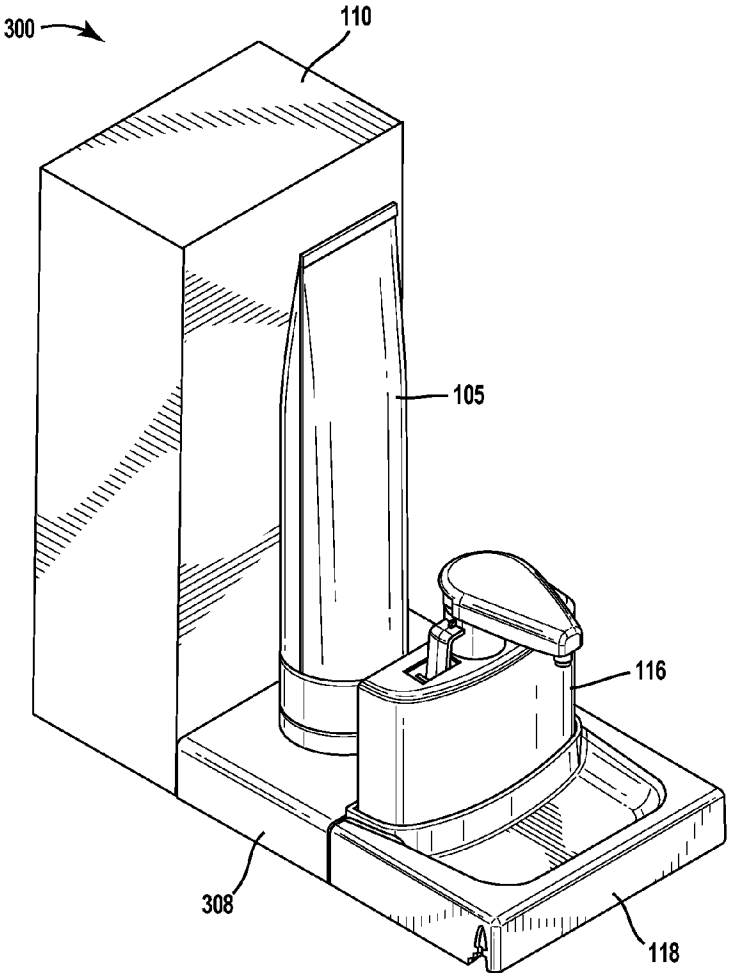
FIG. 20 is a drawing of another a sample dispenser having a shorter elongate tray relative to the sample dispenser of FIG. 1, according to an exemplary embodiment.

In some embodiments, sample dispenser 100 includes an elongate tray 108 extending substantially horizontally over tubing 106 between dosing assembly 104 and cradle assembly 102. Elongate tray 108 may be configured to conceal tubing 106 and to provide structural rigidity for sample dispenser 100 in the assembled state. For example, elongate tray 108 may include engagement features (e.g., clips, notches, grooves, etc.) configured to releasably attach elongate tray 108 to dosing assembly 104 and/or cradle assembly 102. In some embodiments, additional containers of the flowable substance may be placed on elongate tray 108, as shown in FIGS. 19-20. In other embodiments, elongate tray 108 may be omitted and cradle assembly 102 may connect directly to dosing assembly 104. Elongate tray 108 is described in greater detail with reference to FIGS. 11-12.

In some embodiments, sample dispenser 100 includes a base plate 125. Base plate 125 may extend substantially horizontally below dock 114, tube 106, and base 118. Base plate 125 may be formed as a thin sheet or plate and may be configured to attach to the bottoms of dock 114 and base 118. For example, the upper surface of base plate 125 may include any of a variety of engagement features (e.g., clips, notches, grooves, etc.) configured to releasably attach to dock 114 and/or base 118. In some embodiments, the bottom surface of base plate 125 includes one or more features configured to engage, grip, or hold base plate 125 to retail shelf or other surface upon which sample dispenser 100 is placed. For example, the bottom surface of base plate 125 may include magnets, grip pads (e.g., rubber pads, adhesive pads, etc.), fasteners (e.g., clips, notches, grooves, etc.) or other types of engagement features configured to secure base plate 125 to a retail shelf or other surface.

In some embodiments, sample dispenser 100 includes a cover 110. Cover 110 may be placed over cradle assembly 102 and may be configured to conceal cradle assembly 102 when sample dispenser 100 is in the assembled state. In some embodiments, cover 110 may include product logos, product names, and/or other text or graphics promoting or identifying the flowable substance dispensed by sample dispenser 100.

Figure 3:
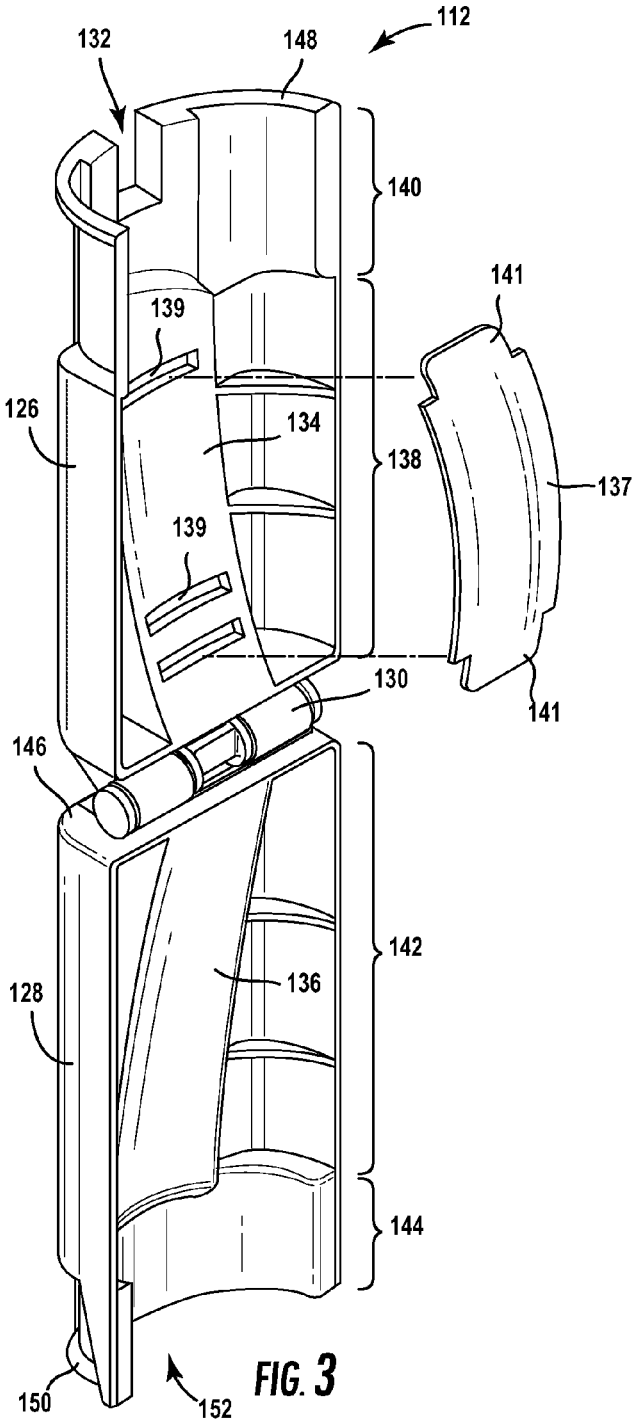
FIG. 3 is a drawing illustrating the priming cradle of the sample dispenser of FIG. 1 in greater detail, showing the priming cradle in an open position, according to an exemplary embodiment.
Figure 4:
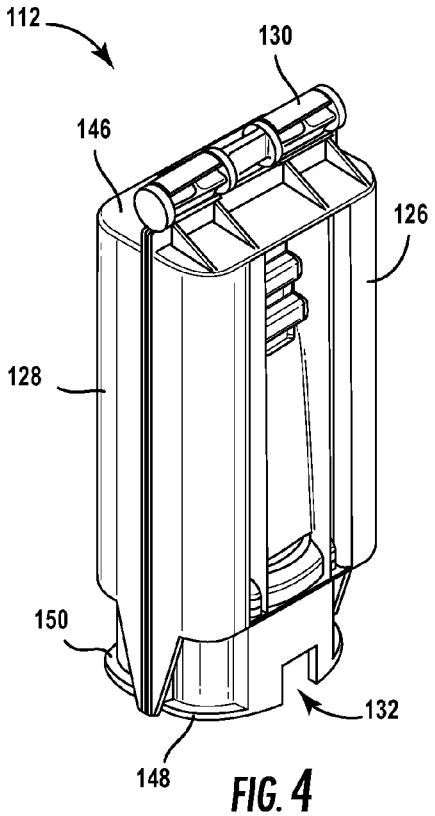
FIG. 4 is a drawing illustrating the priming cradle of FIG. 3 in a closed position, according to an exemplary embodiment.

Referring now to FIGS. 3-4, priming cradle 112 is shown in greater detail, according to an exemplary embodiment. Priming cradle 112 may be configured to hold a compressible container of a flowable substance (e.g., compressible container 105) and to force the flowable substance out of compressible container 105 by applying a compressive force to compressible container 105. In some embodiments, priming cradle 112 includes a substantially hollow shell having a front portion 126 and a rear portion 128. Front portion 126 and rear portion 128 may be hingedly-connected to each other by hinge 130 and configured to rotate about hinge 130. For example, front portion 126 and rear portion 128 may be configured to rotate about hinge 130 between an open position (shown in FIG. 3) and a closed position (shown in FIG. 4). When priming cradle 112 is in the open position, priming cradle may receive compressible container 105. Receiving compressible container 105 may include inserting compressible container 105 into priming cradle 112 or placing priming cradle 112 onto or at least partially around compressible container 105. When priming cradle 112 is moved into the closed position, priming cradle 112 may apply the compressive force to compressible container 105.

Priming cradle 112 may include one or more tapered interior surfaces that apply the compressive force to compressible container 105 when priming cradle 112 is closed around compressible container 105. For example, priming cradle 112 is shown to include a tapered surface 134 along the interior of front portion 126 and a tapered surface 136 along the interior of rear portion 128. In some embodiments, tapered surfaces 134-136 taper gradually outward (e.g., from a central plane dividing priming cradle 112 into front and rear portions 126-128) as tapered surfaces 134-136 extend from a top surface 146 of priming cradle 112 toward bottom edges 148-150 of priming cradle 112.

Tapered surface 134 is shown to include several notches 139. Notches 139 may be configured to receive tabs 141 of a pressure plate 137. Pressure plate 137 may be a flexible (e.g., plastic) plate configured to fit within priming cradle 112. For example, pressure plate 137 may be configured to bend or flex such that tabs 141 can be inserted into notches 139. When tabs 141 are inserted into notches 139, the surface of pressure plate 137 may have the opposite curvature of tapered surface 134 (shown in FIG. 18). This allows pressure plate 137 to apply pressure to a container of a flowable substance held within priming cradle 112 (e.g., a tube of lotion). As priming cradle 112 is closed around the container, pressure plate 137 applies pressure to the container and causes the flowable substance to flow out of the container.

In some embodiments, pressure plate 137 is configured to bend or flex by various degrees to allow tabs 141 to be inserted into any combination of notches 139. The combination of notches 139 into which tabs 141 are inserted can be selected by a user to cause pressure plate 137 to have various shapes and to flex outward from tapered surface 134 by various amounts. For example, inserting tabs 141 into the set of notches 139 furthest apart from each other may cause pressure plate 137 to be relatively flat, whereas inserting tabs 141 into a set of notches 139 that are relatively closer together may cause pressure plate 137 to flex outward by a greater amount. Advantageously, this allows pressure plate 137 to accommodate (e.g., make contact with) any size of container within priming cradle 112.

In some embodiments, each of front portion 126 and rear portion 128 includes a tapered section and a non-tapered section. For example, front portion 126 is shown to include a tapered section 138 and a non-tapered section 140. Similarly, rear portion 128 is shown to include a tapered section 142 and a non-tapered section 144. In some embodiments, tapered sections 138 and 142 are substantially rectangular having a rectangular top surface 146 with or without rounded corners. Non-tapered sections 140 and 144 may be substantially ovular having elliptical or oval-shaped bottom edges 148 and 150. In other embodiments, tapered sections 138 and 142 and non-tapered sections 140 and 144 may have any other shape (e.g., ovular, rectangular, circular, irregularly shaped, etc.) and may be adapted to match the shape of the compressible container that priming cradle 112 is intended to contain. Priming cradle 112 may include an open bottom surface 152 to allow priming cradle 112 to be inserted onto compressible container 105.

In some embodiments, the open volume within priming cradle 112 is substantially less (e.g., narrower, smaller, etc.) proximate to top surface 146 and substantially greater (e.g., wider, larger, etc.) proximate to open bottom surface 152 as a result of tapered surfaces 134-136. Advantageously, this results in the flowable substance being forced downward toward open bottom surface 152 and out of compressible container 105 as priming cradle 112 is closed around compressible container 105. In some embodiments, front portion 126 includes a notch or opening 132 along bottom edge 148 to allow tubing 106 to pass through the outer shell of priming cradle 112.

Figure 5:
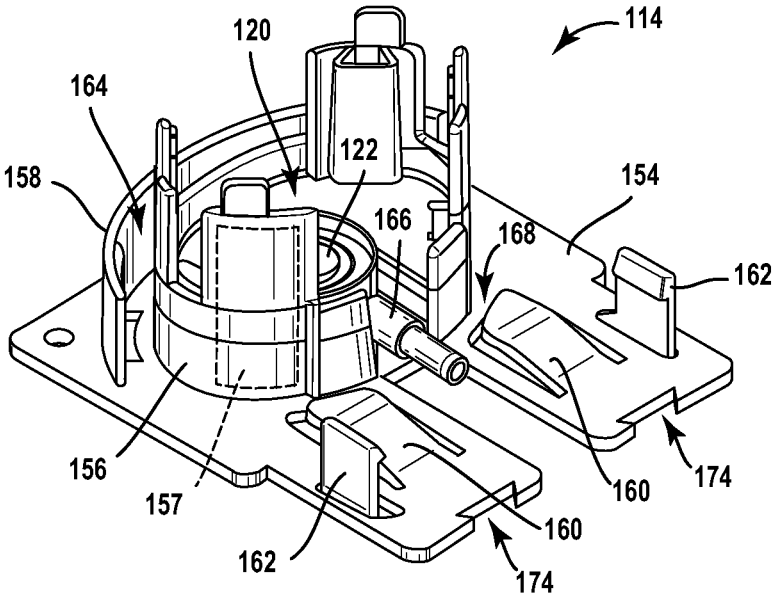
FIG. 5 is a perspective view illustrating the dock of the sample dispenser of FIG. 1 in greater detail, according to an exemplary embodiment.
Figure 6:
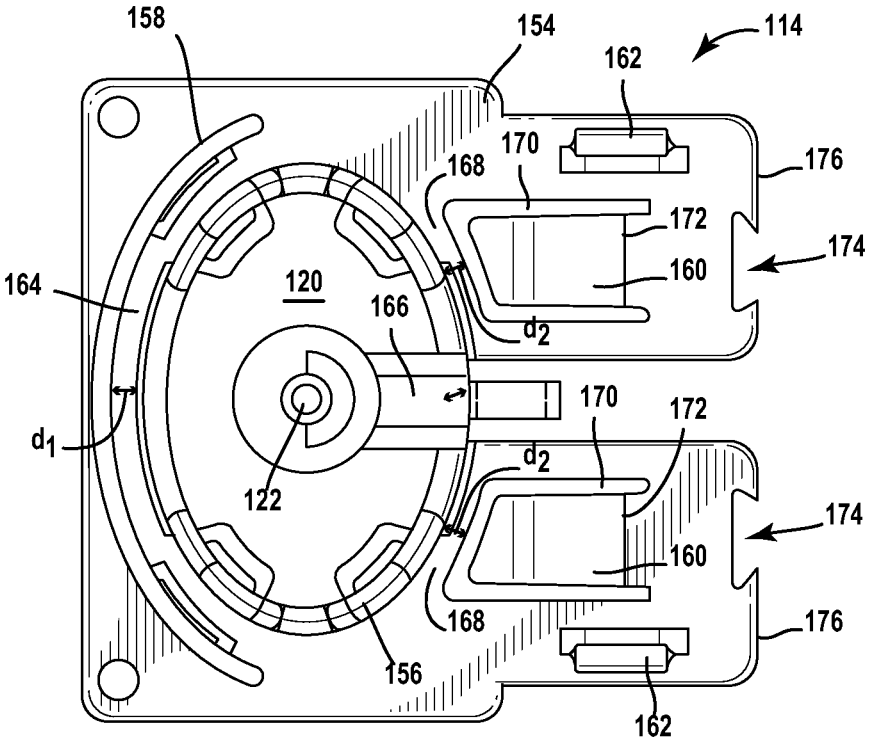
FIG. 6 is a plan view of the dock shown in FIG. 5, according to an exemplary embodiment.

Referring now to FIGS. 5-6, dock 114 is shown in greater detail, according to an exemplary embodiment. Dock 114 is shown to include a floor 154 and a perimeter wall 156 projecting upward from floor 154. Perimeter wall 156 at least partially surrounds and defines a receiving area 120. In some embodiments, one or more portions 157 of perimeter wall 156 may be removed or omitted to reduce the amount of material required to form perimeter wall 156. For example, portions 157 may be replaced with a hollow gap or void such that the upward projections of perimeter wall 156 are substantially hollow perimeters extending upward from floor 154. Corresponding portions 157 may be omitted on each of the four upward projections along perimeter wall 156.

Figure 14:
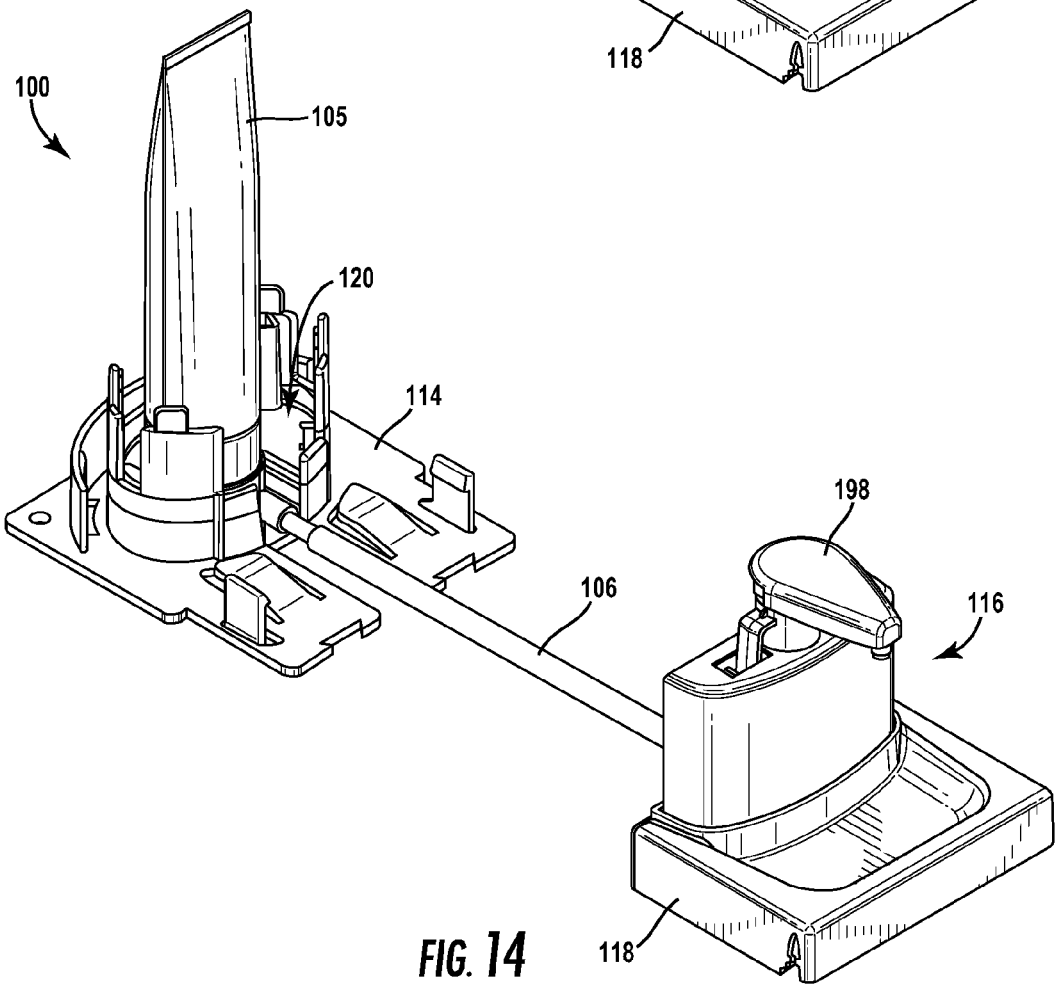
FIG. 14 is a drawing illustrating the sample dispenser of FIG. 1 in the state shown in FIG. 13 with a compressible container positioned within a receiving area of the dock, according to an exemplary embodiment.

Compressible container 105 may be placed within receiving area 120, as shown in FIG. 14. In some embodiments, perimeter wall 156 engages and supports compressible container 105. For example, perimeter wall 156 may contact compressible container 105 and hold compressible container 105 in an upright position. In other embodiments, compressible container 105 occupies less than all of the space within receiving area 120 such that a gap exists between compressible container 105 and perimeter wall 156. Receiving area 120 and perimeter wall 156 are shown as having a substantially ovular or elliptical shape. However, it is contemplated that, receiving area 120 and perimeter wall 156 may have any shape (e.g., ovular, rectangular, circular, irregularly shaped, etc.) and may be adapted to match the shape of the compressible container that dock 114 is configured to support.

Dock 114 is shown to include an upwardly-oriented hollow connector 122 that projects upward from floor 154 within receiving area 120. An opening in compressible container 105 may engage hollow connector 122 when compressible container 105 is placed within receiving area 120. For example, hollow connector 122 may include a tube or other fluid conduit that fits into or around the opening in compressible container 105. The flowable substance may flow into hollow connector 122 when forced out of compressible container 105 by priming cradle 112. In some embodiments, hollow connector 122 includes a seal, gasket, or other component configured to ensure that no leakage occurs when the flowable substance is forced out of compressible container 105.

In some embodiments, hollow connector 122 connects to (or is integral with) an L-shaped joint 166. L-shaped joint 166 may have first end oriented upward and attached to (or integral with) hollow connector 122. L-shaped joint 166 may have a second end oriented horizontally and attached to tubing 106 (e.g., through an opening in perimeter wall 156). In other embodiments, L-shaped joint 166 may be replaced with a differently-shaped joint or connector as may be suitable to connect to different types of compressible containers. For example, if compressible container 105 has an opening that is oriented downward, L-shaped joint 166 may be used to direct the flowable substance horizontally and into tubing 106. However, if compressible container 105 has an opening that is oriented horizontally, L-shaped joint 166 may be omitted or replaced with a straight connector that does not redirect the flowable substance.

Figure 15:
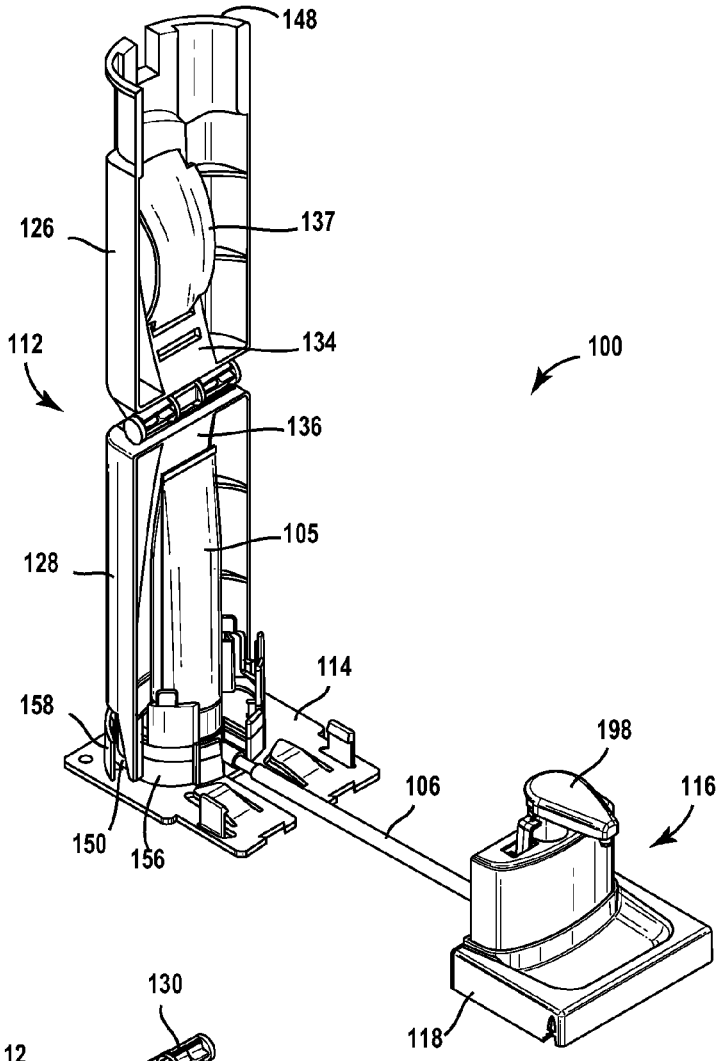
FIG. 15 is a drawing illustrating the sample dispenser of FIG. 1 in a partially assembled state with a rear portion of the priming cradle coupled to the base and with the priming cradle in the open position, according to an exemplary embodiment.

Dock 114 is shown to include a retaining wall 158. Retaining wall 158 may project upward from floor 154 and may be spaced rearward (i.e., to the left in FIG. 6) of perimeter wall 156. Retaining wall 158 and perimeter wall 156 define a space 164 therebetween. In some embodiments, retaining wall 158 has a shape or profile (e.g., curved, straight, etc.) that matches a portion of perimeter wall 156 such that the distance $d_1$ between perimeter wall 156 and retaining wall 158 is substantially uniform throughout space 164. Space 164 may be configured to receive lower edge 150 of priming cradle 112 when priming cradle 112 is attached to dock 114. For example, priming cradle 112 may be inserted onto dock 114 such that lower edge 150 of rear portion 128 fits within space 164, as shown in FIG. 15. Dock 114 may provide support for priming cradle 112 and may hold priming cradle 112 in an upright position.

Dock 114 is shown to include a pair or retaining clips 160. Retaining clips 160 may project upward from floor 154 and may be spaced forward (i.e., to the right in FIG. 6) of perimeter wall 156. Retaining clips 160 and perimeter wall 156 define spaces 168 therebetween. In some embodiments, retaining clips 160 have a shape or profile (e.g., curved, straight, etc.) that matches a portion of perimeter wall 156 such that the distance $d_2$ between perimeter wall 156 and retaining clips 160 is substantially uniform throughout spaces 168. Spaces 168 may be configured to receive lower edge 148 of priming cradle 112 when priming cradle 112 is attached to dock 114.

In some embodiments, retaining clips 160 are connected to floor 154 along a fixed edge 172. The other edges of retaining clips 160 may be separated from floor 154 by a space 170. Retaining clips 160 project upward from fixed edge 172 at an angle toward perimeter wall 156 (e.g., between 0° and 90° relative to horizontal). The angle of retaining clips 160 may allow lower edge 148 of front portion 126 to slide over retaining clips 160 toward perimeter wall 156. Retaining clips 160 may elastically deflect downward as lower edge 148 slides over retaining clips 160. Once front portion 126 has cleared the free edge of retaining clips 160 opposite fixed edge 172, retaining clips 160 may spring upward, locking front portion 126 between retaining clips 160 and perimeter wall 156. Dock 114 may provide support for priming cradle 112 and may hold front portion 126 between retaining clips 160 and perimeter wall 156.

In some embodiments, dock 114 includes engagement features 162 (e.g., clips, snaps, fasteners, connectors, etc.) projecting upward from floor 154. Engagement features 162 may be configured to engage corresponding engagement features 182 of elongate tray 108 (shown in FIG. 12) to releasably attach elongate tray 108 to dock 114. In some embodiments, dock 114 includes connectors 174 (e.g., grooves, notches, projections, etc.) along a forward edge 176 of floor 154. Connectors 174 may be configured to engage corresponding connectors 178 of base 118 (shown in FIGS. 7-8) to releasably attach dock 114 to base 118 (e.g., for embodiments in which elongate tray 108 is not used).

Figure 7:
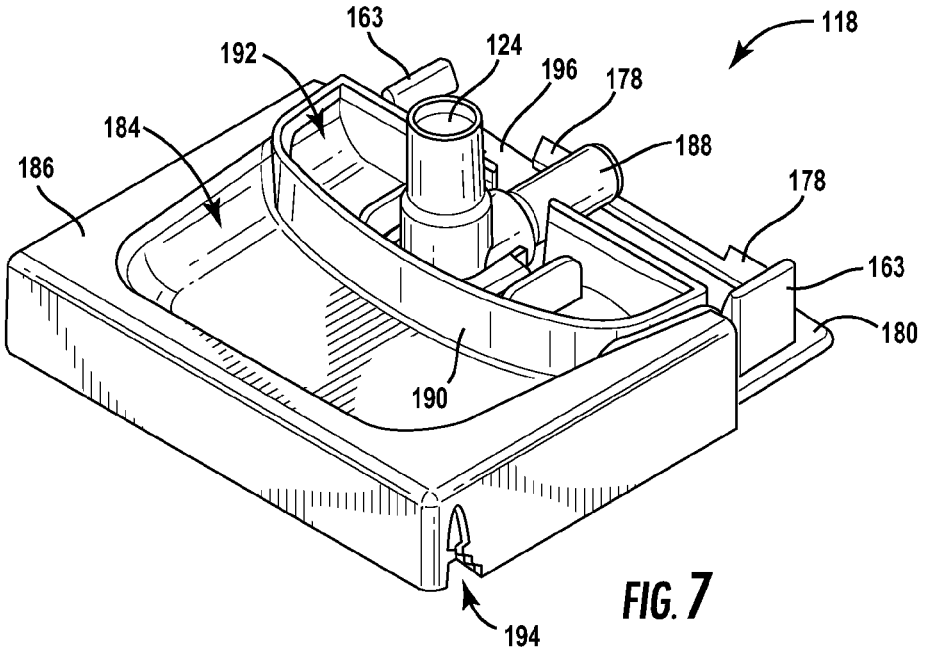
FIG. 7 is a perspective view illustrating the base of the sample dispenser of FIG. 1 in greater detail, according to an exemplary embodiment.
Figure 8:
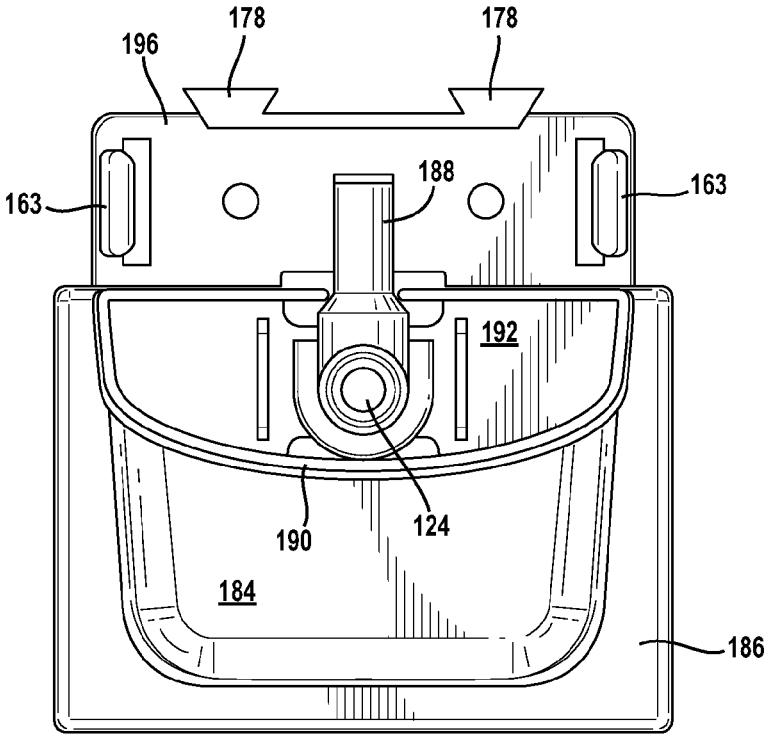
FIG. 8 is a plan view of the base shown in FIG. 7, according to an exemplary embodiment.

Referring now to FIGS. 7-8, base 118 is shown in greater detail, according to an exemplary embodiment. Base 118 may be configured to support dosing unit 116 and may provide physical and/or fluid connections that facilitate connecting dosing unit 116 to tubing 106, elongate tray 108, and/or dock 114. Base 118 is shown to include an upper surface 186 and a drip tray 184 recessed downward into upper surface 186. Drip tray 184 may be configured to catch any leakage and/or excess amount of the flowable substance dispensed by dosing unit 116.

Figure 13:
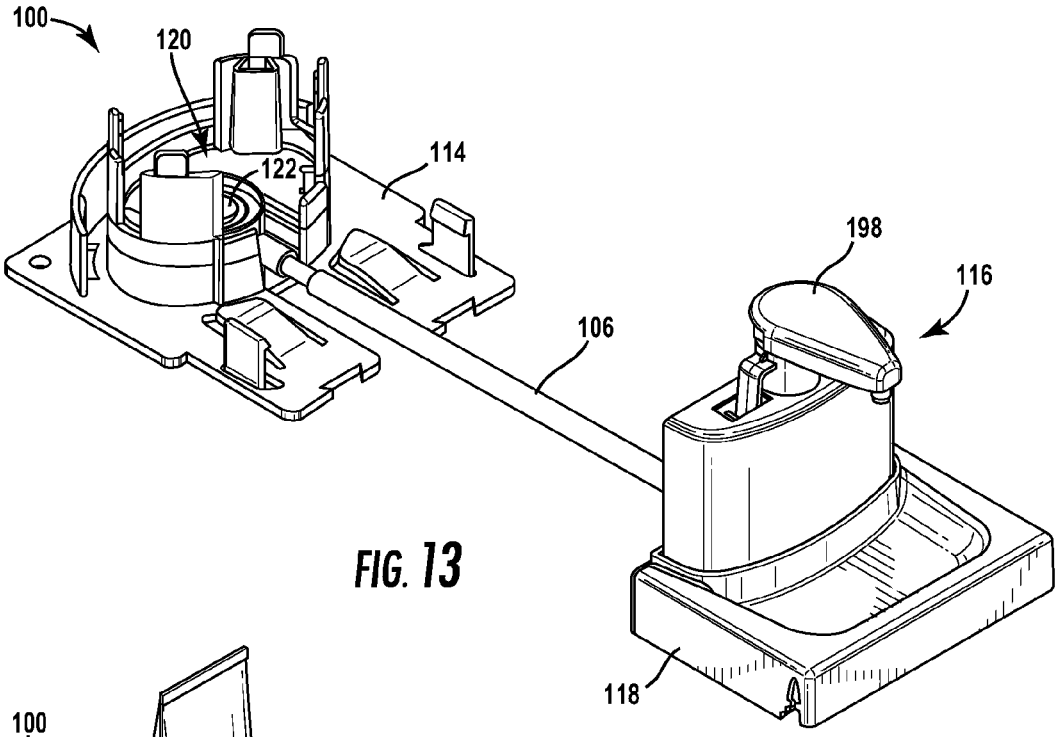
FIG. 13 is a drawing illustrating the sample dispenser of FIG. 1 in a partially assembled state in which the dock is connected to the base by the length of tubing, according to an exemplary embodiment.

Base 118 is shown to include a perimeter wall 190 projecting upward from drip tray 184. Perimeter wall 190 at least partially surrounds and defines a holding area 192. Dosing unit 116 may be placed within holding area 192, as shown in FIG. 13. In some embodiments, perimeter wall 190 engages and supports dosing unit 116. For example, perimeter wall 192 may contact dosing unit 116 and hold dosing unit 116 in an upright position. Holding area 192 and perimeter wall 190 are shown as having a quasi-trapazoidal shape. However, it is contemplated that, holding area 192 and perimeter wall 190 may have any shape (e.g., ovular, rectangular, circular, irregularly shaped, etc.) and may be adapted to match the shape of the dosing unit 116.

Base 118 is shown to include an L-shaped joint 124. L-shaped joint 124 may provide a fluid connection between dosing unit 116 and tubing 106. For example, L-shaped joint 124 may have a first end oriented upward and attached to the mechanical pump within dosing unit 116 and a second end 188 oriented horizontally and attached to tubing 106 (e.g., through an opening in perimeter wall 190).

In some embodiments, base 118 includes engagement features 163 (e.g., clips, snaps, fasteners, connectors, etc.) projecting upward from a floor 196 of base 118. Engagement features 163 may be configured to engage corresponding engagement features 182 of elongate tray 108 (shown in FIG. 12) to releasably attach elongate tray 108 to base 118. In some embodiments, base 118 includes connectors 178 (e.g., grooves, notches, projections, etc.) along a rearward edge 180 of floor 196. Connectors 178 may be configured to engage corresponding connectors 174 of dock 114 to releasably attach base 118 to dock 114 (e.g., for embodiments in which elongate tray 108 is not used). In some embodiments, base 118 includes notches 194 configured to engage a lip, projection, or other engagement feature of a display area or tray (as shown in FIG. 19) to secure sample dispenser 100 in a fixed position relative to the display area or tray.

Figure 10:
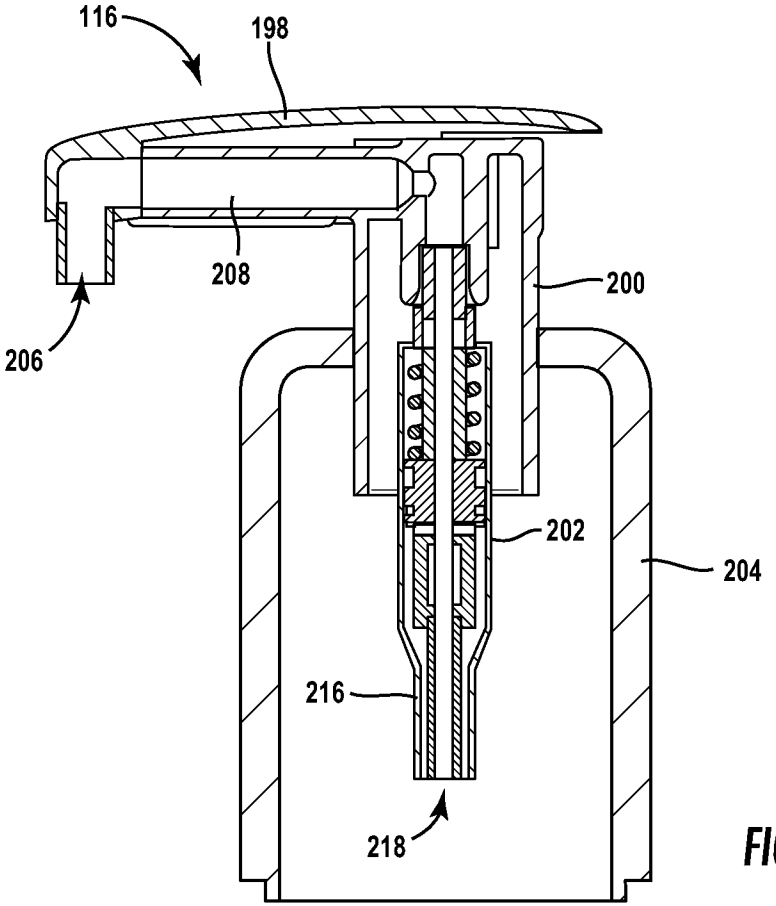
FIG. 10 is a cross-sectional view of the dosing unit shown in FIG. 9, according to an exemplary embodiment.
Figure 9:
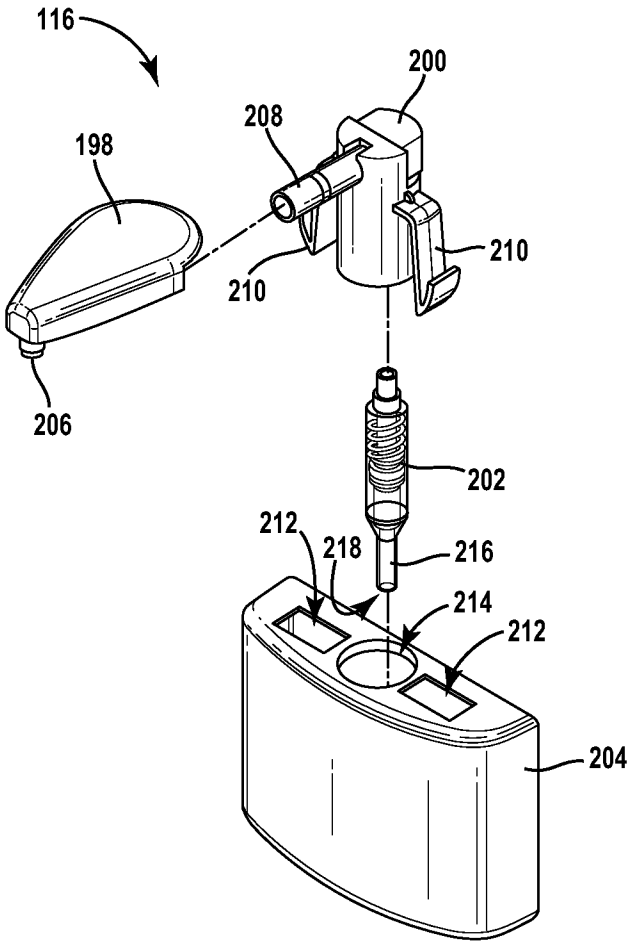
FIG. 9 is an exploded view illustrating the dosing unit of the sample dispenser of FIG. 1 in greater detail, according to an exemplary embodiment.

Referring now to FIGS. 9-10, dosing unit 116 is shown in greater detail, according to an exemplary embodiment. Dosing unit 116 is shown to include a mechanical pump 202, a nozzle 200, a nozzle cover 198, and a shell 204. Shell 204 may be a substantially hollow shell having an open bottom and a closed top and closed sides. Shell 204 may be sized and/or shaped to fit within perimeter wall 190 in holding area 192 of base 118. In some embodiments, mechanical pump 202 and nozzle 200 extend through a central opening 204 in a top surface of shell 204. In some embodiments, shell 204 includes peripheral openings 212 configured to receive clips 210 extending from nozzle 200 to secure nozzle 200 in an operating position relative to shell 204.

Mechanical pump 202 may be configured to drive the flowable substance upward into a fluid conduit 208 within nozzle 200. Mechanical pump 202 is shown to include a lower end 216 having an intake orifice 218. Intake orifice 218 may be connected to a downstream end of tubing 106 (e.g., via L-shaped joint 124). Nozzle cover 198 may attach to nozzle 200 and may include an outlet 206 configured to dispense the flowable substance. A user can press downward on nozzle 200 or nozzle cover 198 to compress mechanical pump 202 and dispense the flowable substance from outlet 206. A spring within mechanical pump 202 causes mechanical pump 202 to automatically return to an expanded state. As mechanical pump 202 returns to the expanded state, the volume within mechanical pump 202 is expanded, which draws the flowable substance upward through orifice 218.

When sample dispenser 100 is initially setup, priming cradle 112 may be used to force the flowable substance through tubing 106 and into dosing unit 116 by applying a compressive force to compressible container 105. Once the flowable substance reaches dosing unit 116, mechanical pump 202 may be operated to draw the flowable substance through tubing 106 and upward into nozzle 200 by creating a suction within mechanical pump 202. The suction created by mechanical pump 202 may be sufficient to move the flowable substance through tubing 106 and may continue to draw more of the flowable substance from compressible container 105.

Figure 11:
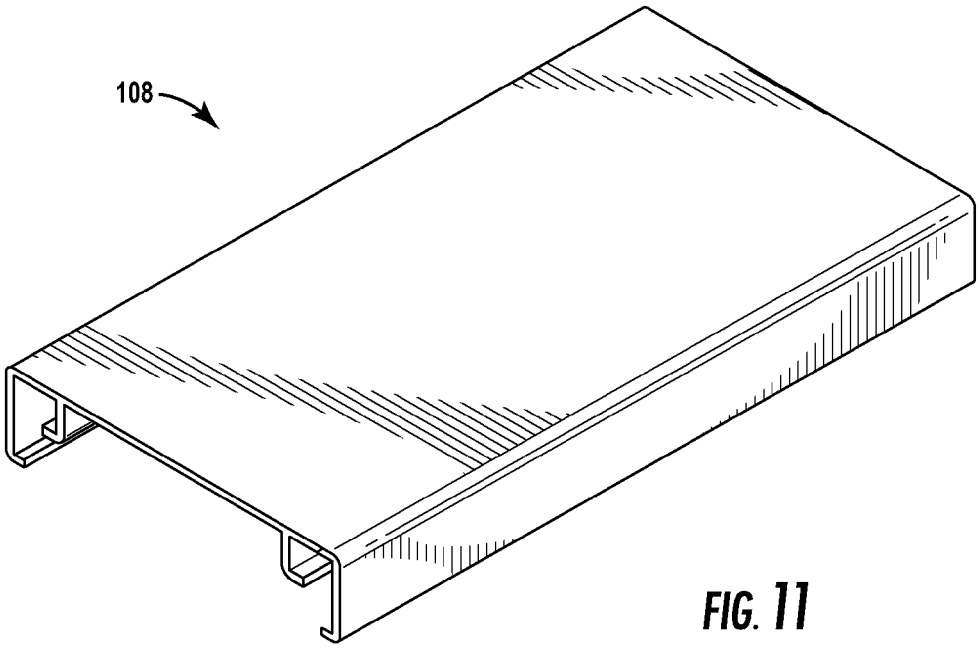
FIG. 11 is a perspective view illustrating the elongate cover of the sample dispenser of FIG. 1 in greater detail, according to an exemplary embodiment.
Figure 12:
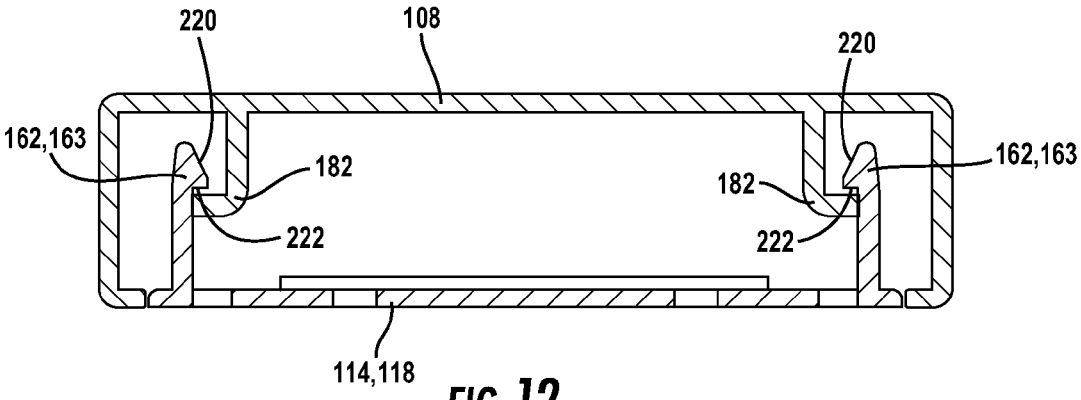
FIG. 12 is a cross-sectional view of the elongate cover of FIG. 11 attached to the dock and/or the base of the sample dispenser of FIG. 1, according to an exemplary embodiment.

Referring now to FIGS. 11-12, elongate tray 108 is shown in greater detail, according to an exemplary embodiment. Elongate tray 108 may extend substantially horizontally over tubing 106 between dosing assembly 104 and cradle assembly 102. Elongate tray 108 may be configured to conceal tubing 106 and to provide structural rigidity for sample dispenser 100 in the assembled state. In some embodiments, additional containers of the flowable substance may be placed on elongate tray 108, as shown in FIGS. 19-20. In other embodiments, elongate tray 108 may be omitted and cradle assembly 102 may connect directly to dosing assembly 104.

Elongate tray 108 is shown to include engagement features 182 for releasably attaching elongate tray 108 to base 118 and dock 114. Engagement features 182 may project horizontally downward and outward from a lower surface of elongate tray 108. In some embodiments, engagement features 182 are configured to slide along a slanted surface 220 of corresponding engagement features 162-163 on dock 114 and/or base 118 as elongate tray 108 is lowered onto dock 114 and/or base 118. An upper surface of engagement features 182 may be configured to engage a lower surface 222 of engagement features 162-163 to releasably attach elongate tray 108 to dock 114 and base 118.

Referring now to FIGS. 13-17, several drawings illustrating a process for dispensing a flowable substance from sample dispenser 100 are shown, according to an exemplary embodiment. As shown in FIG. 13, sample dispenser 100 may be assembled by fluidly connecting dosing unit 116 to dock 114. In some embodiments, dosing unit 116 and dock 114 are connected via tubing 106. For example, tubing 106 may be connected to L-shaped joint 166 of dock 114 and to L-shaped joint 124 of base 118. In other embodiments, dosing unit 116 may be connected directly to dock 114 without requiring tubing 106.

As shown in FIG. 14, compressible container 105 may be placed within receiving area 120 of dock 114. In some embodiments, perimeter wall 156 engages and supports compressible container 105. For example, compressible container 105 may occupy all or substantially all of the space within receiving area 120 such that perimeter wall 156 contacts the surface of compressible container 105. In other embodiments, compressible container 105 occupies less than all of the space within receiving area 120 such that a gap exists between perimeter wall 156 and compressible container 105, as shown in FIG. 14. An opening in compressible container 105 may engage hollow connector 122 when compressible container 105 is placed within receiving area 120. For example, hollow connector 122 may include a tube or other fluid conduit that fits into or around the opening in compressible container 105.

As shown in FIG. 15, priming cradle 112 may be inserted onto dock 114 such that lower edge 150 of rear portion 128 fits within the space between perimeter wall 156 and retaining wall 158. Dock 114 may provide support for priming cradle 112 and may hold priming cradle 112 in an upright position.

Figure 16:
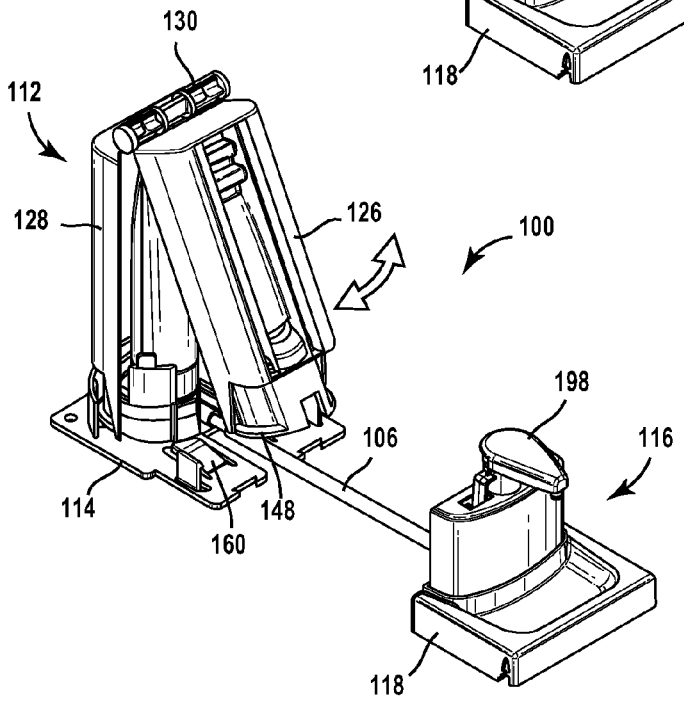
FIG. 16 is a drawing illustrating the sample dispenser of FIG. 1 in the state shown in FIG. 15 with the priming cradle in an intermediate position between the open position and the closed position, according to an exemplary embodiment.

As shown in FIG. 16, front portion 126 of priming cradle 112 may be rotated about hinge 130 toward the closed position. As priming cradle 112 moves into the closed position, tapered surfaces 134 and 136 engage and apply a compressive force to compressible container 105. Tapered surfaces 134-136 may initially engage and apply the compressive force to a top portion of compressible container 105 due to the angle of tapered surfaces 134-136. As priming cradle 112 is moved progressively closer toward the closed position, tapered surfaces 134-136 may engage progressively lower portions of compressible container 105 such that the flowable substance is forced downward within compressible container 105 toward dock 114. The compressive force applied by priming cradle 112 forces the flowable substance out of compressible container 105, through tubing 106, and into dosing unit 116.

As priming cradle 112 approaches the closed position, lower edge 148 of front portion 126 may slide over retaining clips 160 toward perimeter wall 156. Retaining clips 160 may elastically deflect downward as lower edge 148 slides over retaining clips 160. Once front portion 126 has cleared the free edge of retaining clips 160, retaining clips 160 may spring upward, locking front portion 126 between retaining clips 160 and perimeter wall 156. Dock 114 may provide support for priming cradle 112 and may hold front portion 126 between retaining clips 160 and perimeter wall 156.

Figure 17:
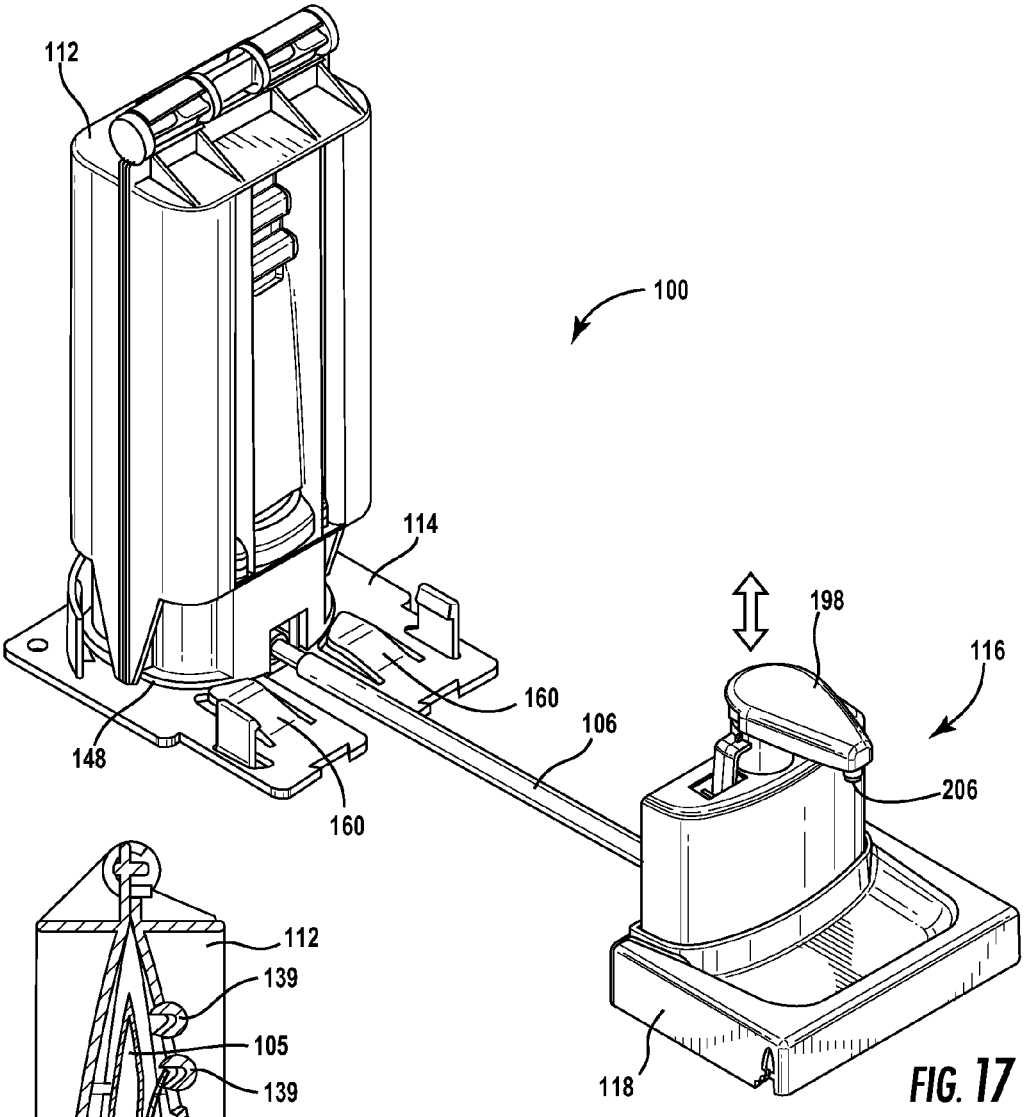
FIG. 17 is a drawing illustrating the sample dispenser of FIG. 1 in the state shown in FIG. 15 with the priming cradle in the closed position, according to an exemplary embodiment.

As shown in FIG. 17, dosing unit 116 can be operated to dispense the flowable substance once the flowable substance reaches dosing unit 116 (i.e., once sample dispenser 100 is primed). For example, a user can press downward on nozzle cover 198, which compresses mechanical pump 202 and causes the flowable substance to be dispensed from outlet 206. Operating dosing unit 116 may create a suction within dosing unit 116 which causes more of the flowable substance to be drawn through tubing 106 from compressible container 105. The compressive force provided by priming cradle 112 may no longer be required to continue moving the flowable substance through tubing 106 since the suction created within dosing unit 116 provides a pressure differential sufficient to draw the flowable substance through tubing 106.

Figure 18:
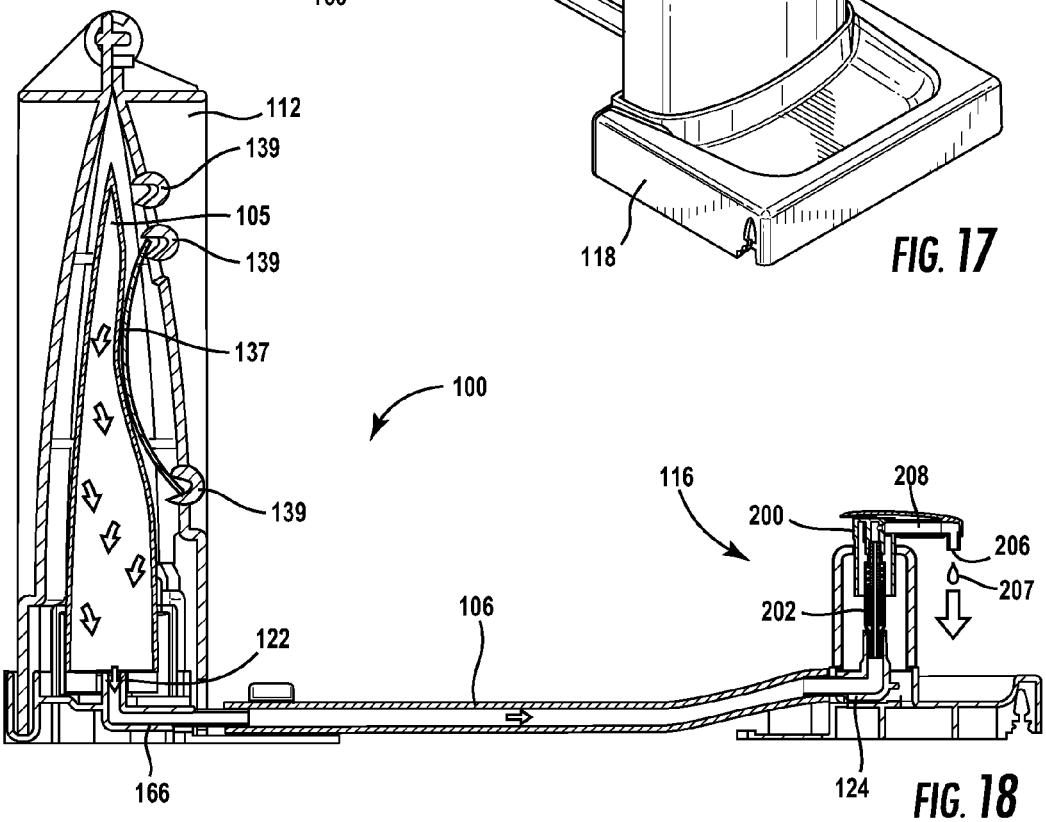
FIG. 18 is a cross-sectional view of the sample dispenser as shown in FIG. 17, according to an exemplary embodiment.

Referring now to FIG. 18, a cross-sectional view of sample dispenser 100 with priming cradle 112 in the closed position is shown, according to an exemplary embodiment. When priming cradle 112 is closed, priming cradle 112 applies a compressive force to compressible container 105, which causes the pressure within compressible container 105 to increase (e.g., to a pressure greater than the ambient pressure around sample dispenser 100). For example, pressure plate 137 may engage and apply a compressive force to the outer surface of compressible container 105, thereby increasing the pressure within compressible container 105. The increased pressure within compressible container 105 forces the flowable substance 207 downward toward the bottom of compressible container 105 and causes flowable substance 207 to flow through L-shaped connector 166, through tubing 106 (i.e., to the right in FIG. 18), and into L-shaped connector 124. Once flowable substance 207 reaches dosing unit 116, sample dispenser 100 is primed and ready for consumer use.

Once sample dispenser 100 is primed, flowable substance 207 can be dispensed by operating dosing unit 116. For example, a user can press downward on nozzle cover 198, which compresses mechanical pump 202 and causes flowable substance 207 to be driven into fluid conduit 208 and dispensed from outlet 206. When nozzle cover 198 is released, a spring within mechanical pump 202 causes mechanical pump 202 to return to an expanded position and creates a suction within mechanical pump 202. The suction causes the pressure within dosing unit 116 to decrease (e.g., to a pressure less than the ambient pressure around sample dispenser 100). The decreased pressure within dosing unit 116 draws flowable substance 207 through tubing 106 (i.e., to the right in FIG. 18) and into dosing unit 116.

In some embodiments, the compressive force provided by priming cradle 112 is used only to prime sample dispenser 100. Priming sample dispenser 100 may include increasing the pressure within compressible container 105 (i.e., using priming cradle 112), which forces flowable substance 207 to initially exit compressible container 105 and flow through tubing 106 toward dosing unit 116. Once flowable substance 207 reaches dosing unit 116, priming is completed and the compressive force provided by priming cradle 112 is no longer required. After the priming stage is completed, dosing unit 116 is operated to create a suction within dosing unit 116, which draws flowable substance 207 through tubing 106 toward dosing unit 116.

Referring now to FIG. 19, several instances of sample dispenser 100 (i.e., sample dispensers 100*a*, 100*b*, and 100*c*) are shown, according to an exemplary embodiment. Sample dispensers 100*a*-100*c* are shown in a side-by-side arrangement in a display tray 214. In other embodiments, sample dispensers 100*a*-100*c* may be placed directly on the shelf and may include base plates 125 configured to grip the upper surface of the shelf, as described with reference to FIG. 2. Each of sample dispensers 100*a*-100*c* may be used to dispense a different type of flowable substance (e.g., different types of lotion, different condiments, etc.). Compressible containers 105*a*, 105*b*, and 105*c* of the flowable substances may be positioned on elongate trays 108*a*, 108*b*, and 108*c*, respectively. Each of compressible containers 105*a*-105*c* may be a sealed container of the flowable substance sampled by the corresponding instance of sample dispenser 100 and may be selected for purchase by a consumer.

Referring now to FIG. 20, another sample dispenser 300 is shown, according to an exemplary embodiment. Sample dispenser 300 may be the same as sample dispenser 100 as described with reference to FIGS. 1-19 except for the distance between cradle assembly 102 and dosing assembly 104. For example, sample dispenser 300 may have a shorter elongate tray 308 compared to the elongate tray 108 of sample dispenser 100. Elongate tray 308 may have a length sufficient to support only a single compressible container 105 thereon. The length of tubing between cradle assembly 102 and dosing assembly 104 in sample dispenser 300 may also be shorter compared to the length of tubing 106 to accommodate the shorter distance between components.

Figure 21:
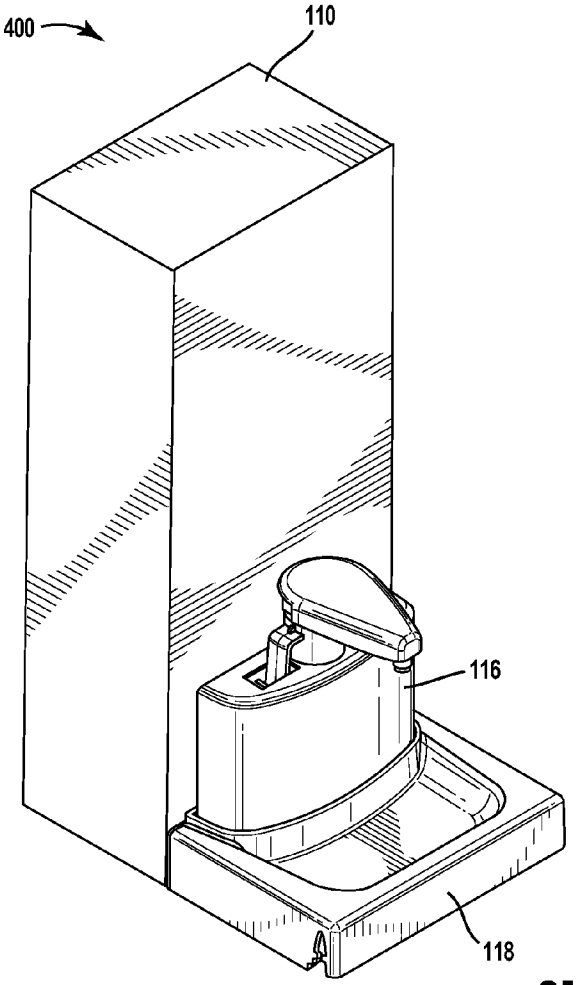
FIG. 21 is a drawing of another a sample dispenser in which the elongate tray is eliminated, according to an exemplary embodiment.

Referring now to FIG. 21, another sample dispenser 400 is shown, according to an exemplary embodiment. Sample dispenser 400 may be the same as sample dispenser 100 as described with reference to FIGS. 1-19 except for the distance between cradle assembly 102 and dosing assembly 104. In sample dispenser 400, elongate tray 108 is not used. Instead, dock 114 connects directly to base 118 using connectors 174 and 178. In some embodiments, sample dispenser 400 eliminates tubing 106. For example, L-shaped connectors 124 and 166 may connect directly to each other without requiring a length of tubing 106 therebetween, or may be replaced by a single U-shaped connector that combines the functions of L-shaped connectors 124 and 166. In other embodiments, sample dispenser 400 uses a shorter length of tubing compared to the length of tubing 106 to accommodate the shorter distance between components.

In some embodiments, priming cradle 112 may be removed or omitted from one or more of the sample dispensers described herein. For example, the embodiments shown in FIGS. 20-21 may optionally omit priming cradle 112. Omitting priming cradle 112 may advantageously reduce material usage and reduce the cost of manufacturing the sample dispenser. In some embodiments, priming cradle 112 is omitted for embodiments in which the flowable product is only transported over a short distance and the pressure added by priming cradle 112 to induce flow is not required.

The construction and arrangement of the sample dispenser as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

What is claimed is:

1. A sample dispenser comprising:

a dosing unit configured to dispense sampling amounts of a flowable substance, the dosing unit comprising a nozzle and a mechanical pump communicating with the nozzle;

a cradle assembly comprising a priming cradle configured to hold a compressible container of the flowable substance and to force the flowable substance out of the compressible container by applying a compressive force to the compressible container, and a dock having a receiving area and therein a floor from which projects an upwardly-oriented hollow connector configured to attach to an opening in the compressible container and a perimeter wall projecting upward from the floor and at least partially surrounding the receiving area, the perimeter wall configured to hold the compressible container in an upward orientation within the receiving area; and tubing connecting the dosing unit and the cradle assembly allowing communication of the flowable substance between the compressible container and the pump wherein the dock comprises one or more retaining clips projecting upward from the floor and spaced from the perimeter wall and further wherein the retaining clips are configured to allow a lower edge of the priming cradle to slide over the retaining clips toward the perimeter wall and to hold the lower edge of the priming cradle between the retaining clips and the perimeter wall.

2. The sample dispenser of claim 1, wherein the priming cradle comprises a substantially hollow shell having hingedly-connected front and rear portions configured to hold the compressible container therebetween.

3. The sample dispenser of claim 2, wherein the front portion is configured to rotate relative to the rear portion between an open position in which the priming cradle receives the compressible container and a closed position in which the priming cradle applies the compressive force to the compressible container.

4. The sample dispenser of claim 1, wherein the priming cradle comprises a tapered interior surface that applies the compressive force to the compressible container when the priming cradle is closed around the compressible container.

5. The sample dispenser of claim 1, wherein the cradle assembly further comprises an L-shaped joint having a first end attached to the upwardly-oriented hollow connector and a second end attached to the tubing.

6. The sample dispenser of claim 1, wherein the dock comprises a retaining wall projecting upward from the floor and spaced from the perimeter wall;

wherein a lower edge of the priming cradle is configured to fit within a space between the perimeter wall and the retaining wall when the priming cradle is attached to the dock.

7. The sample dispenser of claim 1, wherein the dosing unit further comprises an L-shaped joint having a first end attached to the mechanical pump and a second end attached to the tubing.

8. The sample dispenser of claim 1, wherein the tubing extends substantially horizontally between the dosing unit and the cradle assembly;

the sample dispenser further comprising an elongate tray extending substantially horizontally over the tubing between the dosing unit and the cradle assembly.

9. The sample dispenser of claim 8, wherein the elongate tray comprises engagement features configured to releasably attach the elongate tray to at least one of the dosing unit and the cradle assembly.

10. The sample dispenser of claim 1, wherein the priming cradle is configured to force the flowable substance through the tubing and into the dosing assembly;

wherein the mechanical pump is configured to draw the flowable substance through the tubing once the flowable substance has reached the dosing assembly.

11. A sample dispenser comprising:

a dosing unit configured to dispense sampling amounts of a flowable substance, the dosing unit comprising a nozzle and a mechanical pump communicating with the nozzle; and a cradle assembly comprising a priming cradle configured to hold a compressible container of the flowable substance and to force the flowable substance out of the compressible container by applying a compressive force to the compressible container, and a dock and having a receiving area and therein a floor from which projects an upwardly-oriented hollow connector configured to attach to an opening in the compressible container and a perimeter wall projecting upward from the floor and at least partially surrounding the receiving area, the perimeter wall configured to hold the compressible container in an upward orientation within the receiving area; and wherein the dosing unit is connected to the cradle assembly allowing communication of the flowable substance between the compressible container and the pump wherein the dock comprises one or more retaining clips projecting upward from the floor and spaced from the perimeter wall and further wherein the retaining clips are configured to allow a lower edge of the priming cradle to slide over the retaining clips toward the perimeter wall and to hold the lower edge of the priming cradle between the retaining clips and the perimeter wall.

12. The sample dispenser of claim 11, wherein the priming cradle comprises a substantially hollow shell having hingedly-connected front and rear portions configured to hold the compressible container therebetween;

wherein the front portion is configured to rotate relative to the rear portion between an open position in which the priming cradle receives the compressible container and a closed position in which the priming cradle applies the compressive force to the compressible container.

13. The sample dispenser of claim 11, wherein the priming cradle comprises a tapered interior surface that applies the compressive force to the compressible container when the priming cradle is closed around the compressible container.

14. The sample dispenser of claim 11, wherein the cradle assembly further comprises a dock having a receiving area and therein a floor from which projects an upwardly-oriented hollow connector configured to attach to an opening in the compressible container.

15. A method for dispensing a flowable substance from a sample dispenser, the method comprising:

providing a sample dispenser comprising a cradle assembly comprising a priming cradle configured to hold a compressive container, a dock having a receiving area and therein a floor from which projects an upwardly-oriented hollow connector configured to attach to an opening in the compressive container and a perimeter wall projecting upward from the floor and at least partially surrounding the receiving area, the perimeter wall configured to hold the compressive container in an upward orientation within the receiving area, wherein the dock comprising one or more retaining clips projecting upward from the floor and spaced from the perimeter wall and further wherein the retaining clips are configured to allow a lower edge of the priming cradle between the retaining clips and the perimeter wall, a dosing unit, and tubing connecting the cradle assembly to the dosing unit;

attaching a compressible container of the flowable substance to a hollow connector of the cradle assembly;

applying a compressive force to the compressible container by closing the cradle assembly around the compressible container, the compressive force causing the flowable substance to flow out of the compressible container, through the tubing, and into the dosing unit; and operating a mechanical pump of the dosing unit to dispense the flowable substance from a nozzle of the dosing unit communicating with the mechanical pump.

16. The method of claim 15, wherein applying the compressive force to the compressible container comprises closing the priming cradle of the cradle assembly around the compressible container;

wherein the priming cradle comprises a tapered interior surface that applies the compressive force to the compressible container when the priming cradle is closed around the compressible container.

17. The method of claim 15, wherein attaching the compressible container to the hollow connector comprises placing the compressible container in the dock of the cradle assembly.

* * * * *